US008377259B2

(12) United States Patent
Kozuka et al.

(10) Patent No.: US 8,377,259 B2
(45) Date of Patent: Feb. 19, 2013

(54) PROCESSES FOR PREPARING COATED PRINTING PAPERS USING HARDWOOD MECHANICAL PULPS

(75) Inventors: Osamu Kozuka, Tokyo (JP); Koji Kutsuwa, Tokyo (JP); Kazuhiko Ishizuka, Tokyo (JP); Takehiro Yoshimatsu, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 2 days.

(21) Appl. No.: 13/057,314

(22) PCT Filed: Aug. 7, 2009

(86) PCT No.: PCT/JP2009/064040

§ 371 (c)(1),
(2), (4) Date: Apr. 13, 2011

(87) PCT Pub. No.: WO2010/016579

PCT Pub. Date: Feb. 11, 2010

(65) Prior Publication Data

US 2011/0180224 A1 Jul. 28, 2011

(30) Foreign Application Priority Data

Aug. 7, 2008 (JP) ..... 2008/203811
Sep. 30, 2008 (JP) ..... 2008/255273

(51) Int. Cl.
*D21F 11/00* (2006.01)

(52) U.S. Cl. ..... 162/136

(58) Field of Classification Search ..... 162/136, 162/135

See application file for complete search history.

(56) References Cited

U.S. PATENT DOCUMENTS

2005/0016701 A1 1/2005 Nisogi et al.

FOREIGN PATENT DOCUMENTS

| | | |
|---|---|---|
| GB | 2047568 | 12/1980 |
| JP | 55-142794 | 11/1980 |
| JP | 2003-049393 | 2/2003 |
| JP | 2004-197277 | 7/2004 |
| JP | 2005-154951 | 6/2005 |
| JP | 2006-037258 | 2/2006 |
| WO | 03/056101 | 7/2003 |

*Primary Examiner* — Mark Halpern

(74) *Attorney, Agent, or Firm* — Roylance, Abrams, Berdo & Goodman, L.L.P.

(57) ABSTRACT

The present invention provides a process for preparing a coated printing paper, comprising the steps of making a base paper from a stuff containing a hardwood-derived mechanical pulp (LMP) and applying a coating solution containing a pigment and an adhesive by an on-machine coater to provide a coating layer, wherein said steps are continuously performed on machine. According to the present invention, coated printing papers having high quality can be efficiently prepared with high runnability.

4 Claims, No Drawings

PROCESSES FOR PREPARING COATED PRINTING PAPERS USING HARDWOOD MECHANICAL PULPS

This application is a 371 of PCT/JP2009/064040 filed 7 Aug. 2009.

TECHNICAL FIELD

The present invention relates to coated printing papers and processes for preparing them. Especially, the present invention relates to techniques for efficiently preparing coated printing papers having high quality by using hardwood mechanical pulps (LMPs).

BACKGROUND ART

Recently, there has been a growing demand for coated printing papers in the field of commercial printing for advertising or publicity purposes such as advertising leaflets, catalogs, pamphlets, direct mails, etc. It would be desirable to provide these commercial prints with good print finish at low cost because it is important to achieve their purposes as advertising media though their own commercial value is low.

Especially, coated papers have been rapidly downgraded by basis weight reduction to save costs of printing papers since the recent era of low growth started. The background of the basis weight reduction of commercial printing papers is explained by cost saving as economic measures to deal with a decline in corporate profits invited by rising material prices or to reduce transportation costs, as well as social needs such as resource saving and environmental issues. In the mail-order business expanding in the past several years, the demand for basis weight reduction has also been increasing to reduce delivery costs and storage costs of catalogs and direct mails and to increase their pages.

Even in such a trend toward basis weight reduction of printing papers, it would also be desirable to maintain print quality of coated printing papers. Specifically, it is especially important to provide high opacity and resistance to print through (especially, resistance to ink penetration through paper during printing), and it is desirable to provide good brightness, sheet gloss and quality after printing, i.e., print finish.

However, basis weight reduction is incompatible to opacity and reproducibility of printed images so that it is technically difficult to achieve basis weight reduction and high print quality in printing papers at the same time, and the especially important property of opacity would be compromised by basis weight reduction.

Generally, opacity of paper mainly depends on scattering and absorption of light in paper layers, and the more light scatters in paper layers, the less light passes through the paper, which becomes opaque. Thus, a possible way to increase opacity is to increase the absorption coefficient and to increase the scattering coefficient. However, an increase in absorption coefficient results in a decrease in the brightness of paper and leads to a quality drop of coated paper, so that it is especially important to increase the scattering coefficient of paper.

A method for obtaining paper with high opacity and low density was proposed from the aspect of chemicals, which comprises adding a bulking agent consisting of a polyhydric alcohol and a fatty acid ester to hydrophobize pulp fiber surfaces, thereby preparing a low-density paper (see patent document 1). However, this method has disadvantages such as cost increase and paper strength loss because expensive chemicals must be used.

Citation List

Patent Document

Patent document 1: WO2003/056101.

SUMMARY OF INVENTION

Technical Problem

A possible approach for obtaining paper with high opacity and low density from the aspect of raw materials is to use mechanical pulp. Generally, mechanical pulps such as groundwood pulp obtained by grinding wood by a grinder, refiner mechanical pulp obtained by refining wood by a refiner or thermomechanical pulp are effective for density reduction because of their high specific scattering coefficients and rigid fibers as compared with chemical pulps obtained by extracting lignin serving as a reinforcing material in wood fibers with a chemical. However, the use of hardwood-derived mechanical pulp (LMP: leef mechanical pulp) having short fiber length is thought to be more likely to cause problems such as web breaks due to strength loss as compared with softwood-derived mechanical pulp (NMP: needle mechanical pulp), and therefore, hardwood mechanical pulp has not been conventionally used in the field of coated printing papers of low basis weight though the use of softwood mechanical pulp has been proposed. Moreover, softwood-derived mechanical pulp is inconvenient for use in the production of paper products required to have high brightness because it is difficult to prepare high brightness pulp from lignin-rich softwood.

Under these circumstances, the present invention intends to provide a technique for efficiently preparing coated printing paper having high brightness and opacity as well as good printability with high runnability.

Solution To Problem

As a result of careful studies to solve the above problems, we achieved the present invention on the basis of the finding that coated printing paper having high brightness and opacity as well as high printability can be prepared without compromising runnability when a hardwood-derived mechanical pulp (LMP) is used as a raw material pulp in a process for preparing a coated printing paper wherein papermaking, coating and surface-treating steps are continuously performed on machine. Especially, it is preferable to use a hardwood-derived mechanical pulp (LMP) consisting of a chemithermomechanical pulp (CTMP) in which 95% by weight or more of fibers passes through a 24-mesh screen and 20% by weight or more of fibers does not pass through a 42-mesh screen when determined according to JIS P8207. Coated printing paper having good quality can be efficiently prepared by using such hardwood mechanical pulp.

The present invention includes, but not limited to, the following.

(1) A process for preparing a coated printing paper, comprising the steps of: making a base paper from a raw material containing a hardwood-derived mechanical pulp (LMP) representing 5-80% by weight of pulps in the raw material; and applying a coating solution containing a pigment and an adhesive by an on-machine coater to provide a coating layer; wherein said steps are continuously performed on machine.

(2) The process as defined in (1) wherein the hardwood-derived mechanical pulp (LMP) is a chemithermomechanical pulp (CTMP) in which 95% by weight or more of fibers passes through a 24-mesh screen and 20% by weight or more of fibers does not pass through a 42-mesh screen when determined according to JIS P8207.

(3) The process as defined in (1) or (2) wherein the hardwood-derived mechanical pulp (LMP) is derived from the genus *Eucalyptus* having a volume weight of 450 kg/m$^3$ or more.

(4) The process as defined in any one of (1) to (3) wherein the machine speed is 1100 m/min or more.

(5) The process as defined in any one of (1) to (4) further comprising the step of surface-treating the coating layer wherein the papermaking, coating and surface-treating steps are continuously performed on machine.

(6) The process as defined in any one of (1) to (5) wherein the coating step is performed by using a blade coater and/or a film transfer coater.

Advantageous Effects of Invention

According to the present invention, coated printing papers having good quality can be efficiently prepared with high runnability. Especially, according to the present invention, coated printing papers of high quality can be prepared with high speed because papermaking, coating and surface-treating steps can be continuously performed on machine.

DESCRIPTION OF EMBODIMENTS

The present invention provides a process for preparing a coated printing paper, comprising the steps of making a base paper from a raw material containing a hardwood-derived mechanical pulp (LMP) and applying a coating solution containing a pigment and an adhesive by an on-machine coater to provide a coating layer, wherein said steps are continuously performed on machine. The LMP used in the present invention is a mechanical pulp, but excellent in high-speed runnability so that papermaking, coating and surface-treating steps can be continuously performed on machine. In contrast to the conventional on-machine high-speed operation involving significant loss of runnability due to problems of web breaks, the process of the present invention is advantageous for on-machine high-speed operation because problems of web breaks are less likely to occur.

The machine speed in the process of the present invention is not specifically limited, but the present invention is highly advantageous and convenient for high-speed operation. Especially, the process is preferably run under conditions of 1100 m/min or more, more preferably 1200 m/min or more, still more preferably 1300 m/min or more, and can be run at even 1500 m/min or more without problems.

The basis weight of the coated printing paper of the present invention is not specifically limited, but can be for example 30-200 g/m$^2$, preferably 30-100g/m$^2$. In a more preferred embodiment, the lower limit of the basis weight is 35g/m$^2$ or more, more preferably 40g/m$^2$ or more. On the other hand, the upper limit of the basis weight is more preferably 70g/m$^2$ or less, still more preferably 60g/m$^2$ or less. In the present invention, low-basis weight coated papers of 55g/m$^2$ or less, even 50g/m$^2$ or less can also be stably prepared. The density of the coated printing paper of the present invention is preferably 0.60-0.75 g/m$^3$, more preferably 0.60-0.70 g/m$^3$.

The coated printing paper of the present invention can be applied to various printing methods, and can be conveniently used for offset printing, relief printing, gravure printing, etc. The coated printing paper of the present invention can be especially conveniently used for offset printing applications because roughening is reduced and surface strength and blister resistance are improved.

The coated printing paper of the present invention preferably has a surface roughness of 2.0 μm or less, more preferably 1.8 μm or less, still more preferably 1.6 μm or less, most preferably 1.5 μm or less. As used herein, surface roughness refers to PPS roughness determined under conditions of using a hard backing at 1000 kPa according to ISO8791. The coated printing paper of the present invention can be especially convenient for printing applications because it has good surface quality with little gloss micro-unevenness and ink adhesion unevenness so that microscopic images can be reproduced. The coated printing paper of the present invention having such smoothness has good printability because microscopic images can be reproduced. The coated printing paper of the present invention preferably has a specific scattering coefficient of 45 cm$^2$/g or more, more preferably 50 cm$^2$/g or more. The coated printing paper of the present invention having such a specific scattering coefficient is convenient because it has a low basis weight and high opacity and resists print through or the like. In a preferred embodiment, coated papers of the present invention have a surface roughness of 2.0 μm or less, a specific scattering coefficient of 45 cm$^2$/g or more, and a basis weight of 30-55 g/m$^2$.

In a preferred embodiment, the coated printing paper of the present invention has a brightness of 80% or more, more preferably 81% or more, still more preferably 82% or more. In a preferred embodiment, the coated printing paper of the present invention has an opacity of 84% or more, more preferably 84.5% or more, still more preferably 85% or more.

Papermaking Step

The process for preparing a coated printing paper of the present invention comprises the step of making a base paper from a raw material containing a hardwood-derived mechanical pulp (LMP) representing 5-80% by weight of pulps in the raw material. In the present invention, if the amount of LMP used is less than 5% by weight, the invention is less effective, but if the amount of LMP used exceeds 80% by weight, strength loss worsens runnability and increase the tendency to roughening, which deteriorates surface quality. The lower limit of the amount of LMP used is preferably 10% by weight or more, more preferably 15% by weight or more, still more preferably 20% by weight or more. On the other hand, the upper limit of the amount of LMP used is preferably 70% by weight or less, more preferably 60% by weight or less, still more preferably 50% by weight or less.

The hardwood mechanical pulp (LMP) used in the coating base paper of the present invention is not specifically limited and may be any mechanical pulp (LMP) derived from hardwood, including groundwood pulp (GP), refiner groundwood pulp (RGP), thermomechanical pulp (TMP), chemithermomechanical pulp (CTMP), alkaline hydrogen peroxide mechanical pulp (APMP), alkaline hydrogen peroxide thermomechanical pulp (APTMP), etc. Especially, TMP is preferably used in the present invention because of high bulkiness, high opacity and high brightness, among which are preferably used CTMP, APMP, APTMP, especially CTMP. In the present invention, the hardwood mechanical pulp can be prepared by any process and can be routinely obtained. As used herein, thermomechanical pulp (TMP) refers to a pulp obtained by grinding wood chips while applying a temperature and a pressure on the wood chips to soften fibers and lignin playing the role of an adhesive between fibers. TMP is obtained by mechanically grinding wood chips similarly to groundwood pulp (GP), but causes little damage to fibers because lignin is softened. As used herein, chemithermomechanical pulp (CTMP) refers to a pulp belonging to TMP and prepared from wood chips preliminarily immersed in a chemical.

In the present invention, the fiber length of the hardwood mechanical pulp (LMP) is not specifically limited, but the proportion of fibers passing through a 24-mesh screen is preferably 95% or more, more preferably 97% or more when determined according to JIS P8207, in terms of the smoothness, strength, roughening and the like of the product. Normally, the use of mechanical pulps may deteriorate smoothness by rigid and large fibers and increase the tendency to roughening (raising of fibers) during pigment coating and printing, but coated printing papers having good smoothness and opacity as well as high printability such as resistance to roughening, especially good image reproducibility and print through can be obtained by using a hardwood mechanical pulp containing a high proportion of fibers passing through a 24-mesh screen, as described above.

Among mechanical pulps, thermomechanical pulp is characterized by relatively large fiber length, and typical thermomechanical pulp contains 80% or less of fibers rejected by a 24-mesh screen when determined according to JIS P8207. Thus, the resulting sheet tends to have low smoothness and therefore low image reproducibility during printing. When the sheet is coated with a pigment or used for printing in a rotary heatset web offset printer, roughening may be likely to occur so that fibers are raised on the paper surface.

In order that the deterioration of runnability caused by the use of mechanical pulp can be minimized without compromising good smoothness, the proportion of fibers rejected by a 42-mesh screen in the hardwood mechanical pulp of the present invention is preferably 20% or more, more preferably 20% or more and 60% or less when determined according to JIS P8207. Strength loss can be minimized so that problems of web breaks can be reduced and the deterioration of runnability in an on-machine coater can be prevented by using such hardwood mechanical pulp.

It should be noted here that typical groundwood pulp contains 90% or more of fibers passing through a 24-mesh screen when determined according to JIS P8207 and provides good smoothness, but the resulting sheet has low strength and tends to invite a loss of runnability by web breaks or the like because it contains fibers rejected by a 42-mesh screen only at the 10% level and much short fibers.

In the present invention, the wood species of the hardwood mechanical pulp (LMP) is not specifically limited so far as it is a hardwood, and, for example, the species *Eucalyptus* can be conveniently used, including *Eucalyptus globulus, Eucalyptus urograndis, Eucalyptus nitens, Eucalyptus regnans, Eucalyptus fastigata*, etc. In the present invention, mechanical pulps derived from the species *Eucalyptus* are preferred because bulkiness of fibers tends to be retained and opacity of paper can be improved. Among others, *Eucalyptus urograndis* and *Eucalyptus globules* are especially preferred in terms of availability and quality. Especially, hardwood materials having a volume weight of 450 kg/m$^3$ or more are preferably used. Hardwood mechanical pulps prepared from hardwood materials having such properties including *Eucalyptus urograndis* and *Eucalyptus globules* can maintain bulky structures because their fiber lumens are rigid and resist collapsing. The mechanical pulp prepared from hardwood used in the present invention is preferably selected in such a manner that the hand-made paper sheet prepared from this pulp has a density of 0.45 g/cm$^3$ or less, more preferably 0.35 g/cm$^3$ or less.

In the present invention, chemical pulps (softwood bleached kraft pulp (NBKP) or unbleached kraft pulp (NUKP), hardwood bleached kraft pulp (LBKP) or unbleached kraft pulp (LUKP), etc.), mechanical pulps (groundwood pulp (GP), refiner mechanical pulp (RGP), thermomechanical pulp (TMP), chemithermomechanical pulp (CTMP), etc.), deinked pulp (DIP) and the like are used alone or as a mixture in appropriate proportions as raw material pulps for base papers in addition to the hardwood mechanical pulp described above.

In the present invention, known fillers can be optionally used, e.g., inorganic fillers such as white carbon, talc, ground calcium carbonate, precipitated calcium carbonate, kaolin, clay, delaminated kaolin, silica, precipitated calcium carbonate-silica complexes, magnesium carbonate, barium carbonate, barium sulfate, aluminum hydroxide, calcium hydroxide, magnesium hydroxide, zinc hydroxide, zinc oxide, titanium oxide and amorphous silica prepared by neutralization of sodium silicate with mineral acids, and organic fillers such as urea-formalin resins, melamine resins, polystyrene resins and phenol resins can be used alone or in combination. Among them, typical fillers in neutral and alkaline papermaking such as calcium carbonate and precipitated calcium carbonate-silica complexes are preferably used. The filler content in paper is not specifically limited, but the lower limit is preferably 3% solids by weight or more, more preferably 10% solids by weight or more, still more preferably 12% solids by weight or more, and even 15% solids by weight or more. The upper limit of the filler content in paper is preferably 40% solids by weight or less, more preferably 35% solids by weight or less, still more preferably 30% solids by weight or less, and even 25% solids by weight or less. If the filler content in paper is less than 3% solids by weight, sufficient brightness and opacity are hard to achieve, but if it exceeds 40% solids by weight, paper strength (tensile strength, tear strength, etc.) decreases, resulting in problems of web breaks during operation.

In the present invention, known additives for papermaking can be used. For example, internal paper additives such as aluminum sulfate or various anionic, cationic, nonionic or amphoteric retention aids, freeness improvers, paper strength enhancers and internal sizing agents can be optionally used. In addition, dyes, fluorescent whitening agents, pH modifiers, antifoaming agents, pitch control agents, slime control agents or the like can also be added as appropriate.

In the present invention, the base paper can be made in known paper machines such as Fourdrinier machines, gap formers, hybrid formers (on-top formers). Especially, gap former type paper machines are preferably used in which a stock delivered from the headbox runs between two wire cloths so that a wet web is dewatered nearly equally from both sides. Among gap former type paper machines, especially roll and blade gap former type paper machines including a drainage mechanism consisting of a drainage blade immediately downstream of initial drainage through a forming roll can be used to obtain base papers having good surface strength and good surface quality with no difference between both sides because more fillers and fine fibers can be retained on the surface of paper, which helps to cover vessels or the like responsible for picking during printing. The papermaking conditions are not specifically defined, and the pH during papermaking may be acidic, neutral or basic.

Generally, one of important factors determining print quality of coated paper is the ability to retain more coating solution on the surface of the base paper, but especially when a coating layer is to be provided on a bulky base paper before calendering, it is difficult to retain a coating solution on the surface of the base paper at low speed, and therefore, the steps from papermaking through coating to calendaring are preferably continuously performed at high speed such as 1100 m/min or more, even 1300 m/min or more, and more preferably the steps can be performed at 1500 m/min or more, still more preferably 1600 m/min or more, and can be applied to an operation even at about 1800-2500 m/min In the press part of the paper machine in the present invention, a shoe press is preferably used, and when the machine speed is high, one or more tandem type shoe presses are preferably used to allow for the moisture after pressing, and more preferably two or more such presses are used to improve interlayer strength and blister resistance. Operating conditions of the shoe presses are preferably 100 kN/m-1100 kN/m, more preferably 500 kN/m-1100 kN/m. When two or more of the shoe press are used, web breaks and other problems are reduced and high-speed runnability is improved by passing the web in such a manner that the transfer belt comes into contact with the shoe press on the side of the dryer part.

In the paper machine, conventional pre-dryers and after-dryers can also be used, and drying conditions are not specifically limited, either, and can be appropriately determined within the range of normal operation.

In order to improve surface strength, a clear coating solution based on a water-soluble polymer such as a starch can be applied on the base paper to prepare a coating base paper. When a clear coating solution is applied, interlayer strength can be improved by penetration of the adhesive, in addition to the improvement in surface quality of the coating base paper.

A clear coating solution containing 5% solids by weight or more, preferably 8% solids by weight or more of a starch can be applied as the clear coating solution based on an adhesive such as a starch. For example, starches such as oxidized starches, hydroxyethyl etherified starches, oxygen-modified starches can be used alone or in combination. Polyacrylamide, polyvinyl alcohol and the like can also be partially used in combination. Additives such as surface sizing agents, waterproofing agents, water retention agents, thickeners, lubricants may also be added as appropriate. The coating mass of the starch coating solution is preferably 0.5-4.0 g/m$^2$, more preferably 1.0-3.0 g/m$^2$, in terms of blister resistance and roughening.

Clear coaters that can be used in the present invention include rod metering size press coaters, blade metering size press coaters, gate roll coaters, and two-roll size press coaters, among which rod metering size press coaters are preferably used especially from the aspect of improving interlayer strength during high-speed operation.

The basis weight of the coating base paper in the present invention can be selected to match with the subsequent coating step, and may be as low as, but not specifically limited to, about 20-180 g/m$^2$, preferably about 20-80 g/m$^2$, more preferably about 20-50 g/m$^2$, still more preferably about 25-45 g/m$^2$, for example.

In the present invention, the base paper is preferably pre-calendered through an on-line soft calender, on-line chilled calender or the like to provide a uniform coating layer after coating.

Hardwood Chemithermomechanical Pulp (CTMP)

When CTMP is used as the hardwood mechanical pulp of the present invention, CTMP can be routinely prepared. In one embodiment, CTMP can be obtained by a process comprising a pretreatment step of chips with sodium sulfite, a defibration step by primary refining and a beating step by secondary refining. Mechanical pulps prepared through such steps are well-suitable because they confer high opacity and high strength on paper. For example, the pretreatment of chips with sodium sulfite may include impregnation with an aqueous sodium sulfite solution, in which case chips can be compressed and immersed in an aqueous sodium sulfite solution while they are in a compressed state or after they are compressed, and then they can be impregnated with sodium sulfite while pressure is released to expand the chips. In this step, it is preferable to sufficiently impregnate the chips with the aqueous sodium sulfite solution and the compression ratio is preferably 4:1-16:1. If the compression ratio is lower than 4:1, the chips are not amply restored so that the aqueous sodium sulfite solution insufficiently penetrates into the chips, but compression ratios exceeding 16:1 are impractical in terms of apparatus. The compression ratio here is defined as the volume before compression:the volume after compression. To complete the impregnation with the aqueous sodium sulfite solution, a surge bin can be provided after Prex screw or Impressafiner.

In a preferred embodiment, the proportion of sodium sulfite is 0.5-2.0% by weight relative to a bone dry unit of chips. The average fiber length after primary refining slightly varies with the pH of the aqueous sodium sulfite solution. The initial pH of the impregnating aqueous sodium sulfite solution is 4.5-9.5, preferably 7.0-9.5. Sulfuric acid or sodium hydroxide is used for this pH adjustment. Within this range, the long fiber content increases and the average fiber length increases as the pH increases. If the pH exceeds 9.5, this content levels off and the efficiency of the chemical decreases. However, pH levels of less than 4.5 are not preferred because metal components of the machine may undergo corrosion.

The chips impregnated with the aqueous sodium sulfite solution are preferably preheated to facilitate defibration before primary refining. The temperature here is preferably 100-135 ° C.

After the pretreatment step, the chips are sent to the defibration step by primary refining. In this step, a pressurized refiner can be used, and the chips are defibrated into pulp fibers under known conditions except for refiner plates (refiner segments). Refiners such as single disc refiners, conical disc refiners, double disc refiners, twin disc refiners can be used, but single disc refiners are conveniently used because fibrillation of pulp fibers proceeds and high quality pulp can be obtained as the consistency during defibration increases. During the refining step, the consistency of the chips is preferably 20-60% solids by weight, and the processing temperature is preferably 100-180 ° C., more preferably 120-135 ° C.

Then, the defibrated pulp is sent to a secondary refiner at normal pressure, where it is beaten to a desired freeness. In the beating step by secondary refining, the pulp can be refined by using a known refiner under known conditions to a desired pulp freeness. This step is performed at normal pressure preferably using a conventional normal pressure refiner at a consistency of about 4-60%. The secondary refiner may consist of one or more stages.

After the secondary refining step, bleaching may be optionally performed. Any of known bleaching agents used for the preparation of BCTMP can be used. Preferably, peroxides such as hydrogen peroxide are used. In this case, chelating agents such as ethylene diamine tetraacetate (EDTA) can be used in combination for the purpose of preventing degradation of the peroxides by metal ions. These treatments can be performed under known conditions. Hardwood mechanical pulps of the present invention preferably have a Canadian Standard Freeness of 50-350 ml.

Coating Step

The process for preparing a coated printing paper according to the present invention comprises the step of applying a coating solution containing a pigment and an adhesive using an on-machine coater on the coating base paper obtained as described above. Thus, the coated printing paper of the present invention has a pigment coating layer on a base paper.

The pigment used in the present invention is not specifically limited, but can be any of those conventionally used for coated papers. For example, inorganic pigments such as kaolin, clay, delaminated clay, ground calcium carbonate, precipitated calcium carbonate, talc, titanium dioxide, barium sulfate, calcium sulfate, zinc oxide, silicic acid, silicates, colloidal silica and satin white; organic pigments such as plastic pigments; as well as organic/inorganic composite pigments can be used alone or as a mixture of two or more of them, as appropriate.

In the present invention, it is preferable to use engineered kaolin having a more homogeneous particle size and narrow distribution to ensure coverage of a coated paper having a low basis weight by a coating layer. In a preferred embodiment, its proportion is preferably 40-80 parts by weight, more preferably 50-70 parts by weight per 100 parts by weight of the pigment system.

A pigment preferably used for pigment coating in the present invention is calcium carbonate obtained by wet-milling precipitated calcium carbonate in the form of spindle-like calcite crystals and having an average particle size ($d_{50}$) of 0.1-0.5 μm as determined by an X-ray transmission type particle size distribution analyzer, a BET specific surface area of 10-30 $m^2/g$, and a narrowness of 50 or more, more preferably 60 or more as determined by an X-ray transmission type particle size distribution analyzer and expressed by the formula below:

$$\text{Narrowness}=(d_{30}/d_{70})\times 100$$

wherein $d_{30}$ is a particle size of 30% by weight cumulative, and $d_{70}$ is a particle size of 70% by weight cumulative. Such calcium carbonate is preferably applied as a pigment coating because it provides a coated printing paper having good print through.

When the above-defined calcium carbonate is used in the present invention, it is preferable to use calcite crystals of rosette-like secondary particles formed by aggregation of spindle-like primary particles as precipitated calcium carbonate before milling, and more preferably, the precipitated calcium carbonate before milling has an average particle size ($d_{50}$) of 1.4-3.0μm as determined by an X-ray transmission type particle size distribution analyzer, and a BET specific surface area of 4-12 $m^2/g$. When the above-defined calcium carbonate is used in the present invention, it is preferably wet-milled in a multi-pass mill The proportion of the milled calcium carbonate is preferably 20-60 parts by weight, more preferably 30-50 parts by weight per 100 parts by weight of the pigment system.

The adhesive used in the present invention is not specifically limited, and can be any of adhesives (binders) conventionally used for coated papers. For example, one or more of conventional adhesives for coated papers can be selected and used as appropriate, e.g., synthetic adhesives such as various copolymers including styrene-butadiene copolymers, styrene-acrylic copolymers, ethylene-vinyl acetate copolymers, butadiene-methyl methacrylate copolymers and vinyl acetate-butyl acrylate copolymers, or polyvinyl alcohols, maleic anhydride copolymers and acrylic-methyl methacrylate copolymers; proteins such as casein, soybean protein and synthetic proteins; starches such as oxidized starches, cationic starches, urea phosphate-esterified starches and etherified starches such as hydroxyethyl etherified starches; and cellulose derivatives such as carboxyethyl cellulose, hydroxyethyl cellulose and hydroxymethyl cellulose. In a preferred embodiment, these adhesives are used in the range of 5-50 parts by weight, more preferably 10-30 parts by weight per 100 parts by weight of the pigment. If the amounts of the adhesives are excessive, operation problems such as boiling are likely to occur during film transfer coating, but if the amounts of the adhesives are smaller, it is difficult to achieve sufficient surface strength when the base paper is coated by the film transfer method. In addition, various additives incorporated in conventional pigments for coated paper such as dispersants, thickeners, water retention agents, antifoamers, waterproofing agents, colorants, etc. may be used as appropriate.

When a coating solution based on a pigment and an adhesive is applied in the present invention, one or more layers can be applied on one side or both sides of a base paper by applying the solution on the coating base paper using a blade coater, bar coater, roll coater, air knife coater, reverse roll coater, curtain coater, rod metering size press coater, blade metering size press coater, gate roll coater, or by directly spraying a coating such as OptiSpray on the coating base paper using a spray nozzle.

Among them, blade coaters such as flooded nip blade coaters, jet fountain blade coaters, short dwell time applicator blade coaters, etc. are preferable in terms of image reproducibility after printing, and especially from the aspect of high-speed coatability, short dwell time applicator blade coaters are preferably adopted. In the present invention, web breaks or other problems are less likely to occur and runnability is good because the coating is scraped by the blade shortly after it is supplied to the base paper, i.e., the base paper is wetted with the coating only briefly even during high-speed on-machine blade coating.

In another preferred embodiment of the present invention, one or more layers of a coating containing a pigment and an adhesive are applied on one side or both sides of a base paper by using a film transfer type coater such as gate roll coater, rod metering size press coater or blade metering size press coater to provide a pigment coating layer. Film transfer type coaters such as gate roll coaters, rod metering size press coaters and blade metering size press coaters are designed to transfer a metered amount of a coating solution on an applicator roll to a base paper to provide a coating layer and have the advantage that problems of web breaks or the like during operation are reduced because of the limited load on the base paper during coating. In the present invention, runnability can be improved by controlling the viscosity of the coating in a proper range to reduce boiling incidental to coating by film transfer type coaters such as gate roll coaters. In the present invention, coating can be performed by an on-machine or off-machine coater, but more advantageously by an on-machine coater, because the process of the present invention is excellent in runnability, especially high-speed runnability, and therefore especially suitable for operation at a machine speed of 1100 m/min or more.

The coating mass of the coating solution applied by the coating method described above is preferably 2-20 $g/m^2$, more preferably 3-15 $g/m^2$, still more preferably 4-12 $g/m^2$, even 4-8 $g/m^2$ per side of a base paper. If the coating mass resides in this range, the base paper can be sufficiently covered with coating layers and the resulting coated paper has good printability. One or more coating layers may be provided.

The preparation method of the pigment coating solution is not specifically limited, but in a preferred embodiment, the solids content of the coating solution is about 30-68% by weight. In a preferred embodiment of the film transfer method, the solids content of the coating solution is 40-55% by weight, more preferably 45-55% by weight, and the viscosity of the coating solution is preferably in the rage of 500-1000 mPa·s expressed as a Brookfield viscosity measured at 60 rpm.

In the present invention, the wet coating layer can be dried by using various methods alone or in combination including, but not limited to, a steam-heated cylinder, hot air dryer, gas heater dryer, electric heater dryer, infrared heater dryer or the like.

In the present invention, a pigment coating solution containing a pigment and an adhesive as described above can be applied as a top coating on the paper precoated with a pigment coating solution containing a pigment and an adhesive instead of a clear coating solution.

Pigments used for precoating mainly include ground calcium carbonate optionally in combination with precipitated calcium carbonate, kaolin, clay, talc, satin white, plastic pigments, titanium dioxide, etc., depending on the required quality. Adhesives used in the pigment coating solution include synthetic adhesives such as emulsions of various copolymers including styrene-butadiene copolymers, styrene-acrylic copolymers, ethylene-vinyl acetate copolymers, etc., and polyvinyl alcohols, maleic anhydride copolymers, etc., as well as oxidized starches, esterified starches, enzyme-modified starches, etherified starches and cold water soluble starches obtained by flash-drying them. The pigment coating solution of the present invention may contain various additives used in conventional pigments for coated papers such as dispersants, thickeners, water retention agents, antifoamers, waterproofing agents, etc. Coaters that can be used for precoating in the present invention include rod metering size press coaters, blade metering size press coaters, gate roll coaters, and two-roll size press coaters, among which rod metering size press coaters are preferably used especially from the aspect of improving interlayer strength during high-speed operation.

The coating mass of the pigment precoating solution is preferably in a range of 1-12 g/m$^2$, more preferably 1-10 g/m$^2$, still more preferably 2-8g/m$^2$, most preferably 2-5 g/m$^2$ based on solids per side of a base paper on both sides. Coating masses of less than 1 g/m$^2$ are difficult to apply, and if the concentration of the coating solution is lowered, the coating solution significantly penetrates into the base paper, which contributes to surface quality loss. If the coating mass is more than 12 g/m$^2$, the concentration of the coating solution must be increased, which makes it difficult to control the coating mass in terms of apparatus. The coated web dried after coating may be precalendered through a chilled calender, soft calender or the like before it is coated with a pigment top coating solution.

Surface-Treating Step

In the present invention, the paper provided with coating layers as described above is surface-treated by using a supercalender or soft calender or the like, if desired. Smoothness and gloss of the coated paper can be improved by surface treatment.

In a preferred embodiment, the process for preparing a coated printing paper of the present invention comprises the step of surface-treating the coating layer. Particularly, the surface treatment in the present invention is preferably performed by using a soft calender consisting of a metallic roll and an elastic roll, more preferably an on-line calendar.

Generally, when a surface treatment is performed by using an on-line hot soft calender consisting of a metallic roll and an elastic roll after providing a coating layer, the surface temperature of the metallic roll and the nip pressure of the calendar are important factors because they have a great influence on the density, which greatly contributes to gloss and opacity.

The surface treatment of the present invention is preferably performed under conditions of two or more nips, more preferably three or more nips, still more preferably four or more nips. Normally, an increase in calendar load to improve smoothness in low-basis weight coated papers invites opacity loss and helps to cause web breaks. Surface treatment under conditions of four or more nips allows the calendar load to be dispersed so that an increase in density influencing opacity can be limited while obtaining a desired smoothness. Especially, surface treatment in a hot soft calendar having at least four or more nips made it possible to prepare coated printing papers having a low basis weight on machine without compromising quality under high-speed operation conditions.

The surface temperature of the metallic roll is preferably 100° C. or more and 300° C. or less. If the moisture content of the coated paper is suitable, the coating layer can be smoothened at a low nip pressure or for a short nip dwell time by using a metallic roll heated at 100° C. or more, whereby a coated paper having a low density, high opacity and good smoothness can be efficiently produced with high runnability because the throughput increases over conventional supercalenders and reel changes can be omitted.

The threading speed is preferably about 1000-3000 m/min, and the linear pressure is preferably about 30-500 kg/cm. The moisture content of the coating before calendaring is preferably 3-12%, more preferably 4-8% to optimize smoothness and runnability simultaneously.

The material of the elastic roll used as a pair with the metallic roll in the soft calender is not specifically limited, but a resin roll showing durability at high temperatures and high pressures is preferably used such as modified urethane resins, epoxy resins, polyamide resins, phenol resins, polyether resins, polyacrylate resins, etc. The resin roll preferably has a Shore D hardness of 80-100°, more preferably 85-97°, still more preferably 90-96°, most preferably 92-96°.

EXAMPLES

The following examples further illustrate the present invention without, however, limiting the invention thereto. Unless otherwise specified, parts and % as used herein refer to parts by weight and % by weight, respectively, and numerical intervals are intended to include their endpoints.

Experiment 1

<Evaluation Methods>

Coating solutions and the resulting coated printing papers were tested by the evaluation methods as shown below.

(1) Surface roughness (PPS roughness): determined at 1000 kPa using a hard backing according to ISO 8791.

(2) Specific scattering coefficient: calculated according to ISO 9416.

(3) Print quality (reproducibility of printed images) Printing was performed in 20,000 copies in a rotary offset press (4 color) at a printing speed of 500 rpm using rotary offset printing inks (LEO-XM from Toyo Ink Mfg. Co., Ltd.) in the order of black →cyan →magenta →yellow, and then reproducibility of printed images was visually evaluated. Evaluation standards are as follows: ◎: very good, ○: good, Δ: slightly poor, ×: poor.

(4) Print Quality (Print Through)

Printing was performed in 20,000 copies in a rotary offset press (4 color) at a printing speed of 500 rpm using rotary offset printing inks (LEO-XM from Toyo Ink Mfg. Co., Ltd.) in the order of black→cyan→magenta→yellow, and then print through was visually evaluated. Evaluation standards are as follows: ◎: very good, ○: good, Δ: slightly poor, ×: poor.

(5) Roughening

Coated papers were tested for roughening by the paper surface analyzer FIBRO 1000 from Fibro. This tester evaluates raised fibers on the surface of a specimen by image analysis using a CCD camera after the surface of the specimen is wetted with water and dried by an infrared lamp. Roughening was evaluated from Qty value (number of fibers/m), i.e., the number of fibers 0 1 mm or more raised above the base line under conditions of a water amount of 8.0 g/m$^2$ and a drying temperature of 150° C. Thus, smaller Qty values indicate better roughening.

(6) High-Speed Runnability

High-speed runnability was visually evaluated. High-speed runnability was evaluated from resistance to web breaks in various steps including the press part, resistance to mist generation during coating, resistance to shrinkage-induced wrinkles during calendaring, etc. Evaluation standards are as follows: ◎: very good, ○: good, Δ: slightly poor, ×: poor.

<Preparation of Coated Printing Papers>

Example 1

The hardwood mechanical pulp used was a hardwood chemithermomechanical pulp (CTMP: hand-made paper sheet density 0.37 g/m$^3$, Canadian Standard Freeness 128 ml) prepared from wood chips of *Eucalyptus globulus* having a volume weight of 580 kg/m$^3$ by the method described herein using sodium sulfite in such manner that 100% of fibers may pass through a 24-mesh screen and 20% of fibers may not pass through a 42-mesh screen when determined according to JIS P 8207. A hand-made paper sheet of CTMP having a basis weight of 60 g/m$^2$ was prepared according to JIS P 8222: 1998, and the thickness and the basis weight of the resulting hand-made paper sheet were actually measured and the density was calculated therefrom. Similarly, hand-made paper sheets having a basis weight of 60 g/m$^2$ were prepared from the other pulps according to JIS P 8222: 1998 and the density of each sheet was determined.

A pulp slurry containing 20 parts of this hardwood CTMP, 20 parts of a hardwood kraft pulp (LBKP), 35 parts of a softwood kraft pulp (NBKP), and 25 parts of a recycled pulp (DIP) was prepared as a raw material of a base paper, and 12 parts of precipitated calcium carbonate as a filler and a cationic paper strength enhancer as an internal paper strength enhancer in an amount of 0.5% relative to the pulp were added to prepare a stock. This stock was used in an on-top former at a machine speed of 1200 m/min to give a base paper having a basis weight of 37 g/m$^2$.

Then, 6.5 parts of an oxidized starch and 13 parts of a carboxyl-modified styrene-butadiene copolymer latex were added as adhesives in a total of 19.5 parts per 100 parts of a pigment containing 39 parts of ground calcium carbonate and 61 parts of kaolin to prepare a coating solution having a solids content of 60% and the pigment coating solution was applied on both sides at a coating mass of 5 g/m$^2$ per side using a short dwell time applicator type blade coater and dried.

Subsequently, the coated web was continuously treated in a surface-treating step using a hot soft calender consisting of 4 stacks of 2 rolls under conditions of a metallic roll surface temperature of 200° C. and a linear pressure of 250 kN/m to give a coated printing paper.

In this example, the papermaking, coating and surface-treating steps were continuously performed, so that not only the papermaking speed but also the coating and calendering speeds were 1200 m/min.

Example 2

A coated printing paper was obtained in the same manner as described in Example 1 except that the pulp composition in the base paper in Example 1 was changed to 40 parts of the hardwood chemithermomechanical pulp, 20 parts of the hardwood kraft pulp, 35 parts of the softwood kraft pulp, and 5 parts of the recycled pulp.

Example 3

A coated printing paper was obtained in the same manner as described in Example 1 except that the hardwood chemithermomechanical pulp in Example 1 was prepared in such manner that 98% of fibers may pass through a 24-mesh screen and 33% of fibers may not pass through a 42-mesh screen when determined according to JIS P 8207 (CTMP: hand-made paper sheet density 0.33 g/m$^3$, Canadian Standard Freeness 249 ml).

Example 4

A coated printing paper was obtained in the same manner as described in Example 1 except that ground calcium carbonate in Example 1 was replaced by milled precipitated calcium carbonate as follows.

In this example, a slurry containing 20% solids content of calcium carbonate in the form of calcite crystals of rosette-like secondary particles formed by aggregation of spindle-like primary particles (TP221BM from Okutama Kogyo Co., Ltd.) and 1.5 parts by weight of a polyacrylate dispersant was wet-milled in the multi-pass mill SC Mill Long (SC-MILL type 100 from Mitsui Mining Co., Ltd.) and the resulting calcium carbonate was used as a pigment. The milled calcium carbonate had an average particle size ($d_{50}$) of 0.38 μm as determined by an X-ray transmission type particle size distribution analyzer, a BET specific surface area of 22.5 m$^2$/g, and a narrowness of 62. Here, narrowness is an indicator of narrowness of the particle size distribution determined by an X-ray transmission type particle size distribution analyzer (SediGraph 5100 from Micromeritics) and expressed by the formula below:

$$\text{Narrowness}=(d_{30}/d_{70})\times 100$$

wherein $d_{30}$ is a particle size of 30% by weight cumulative, and $d_{70}$ is a particle size of 70% by weight cumulative. The precipitated calcium carbonate in the form of calcite crystals of rosette-like secondary particles formed by aggregation of spindle-like primary particles before milling had an average particle size ($d_{50}$) of 2.2 μm as determined by an X-ray transmission type particle size distribution analyzer, and a BET specific surface area of 5.9 m$^2$/g.

Example 5

A coated printing paper was obtained in the same manner as described in Example 1 except that the hardwood mechanical pulp in Example 1 was replaced by a hardwood chemithermomechanical pulp (CTMP: hand-made paper sheet density 0.41 g/m$^3$, Canadian Standard Freeness 130 ml) prepared from aspen having a volume weight of 380 kg/m$^3$ in such manner that 100% of fibers may pass through a 24-mesh screen and 26% of fibers may not pass through a 42-mesh screen when determined according to JIS P 8207.

Example 6

A coated printing paper was obtained in the same manner as described in Example 1 except that the hardwood chemithermomechanical pulp in Example 1 was prepared in such manner that 93% of fibers may pass through a 24-mesh screen and 41% of fibers may not pass through a 42-mesh screen when determined according to JIS P 8207 (CTMP: hand-made paper sheet density 0.30 g/m$^3$, Canadian Standard Freeness 267 ml).

Example 7

A coated printing paper was obtained in the same manner as described in Example 1 except that the coated web was continuously treated in a surface-treating step subsequent to coating using a hot soft calender consisting of 2 stacks of 2 rolls in Example 1.

Comparative Example 1

A coated printing paper was obtained in the same manner as described in Example 1 except that the pulp composition in Example 1 was changed to 20 parts of a thermomechanical pulp prepared from softwood chips (TMP: hand-made paper sheet density 0.48 g/m$^3$, Canadian Standard Freeness 90 ml), 20 parts of the hardwood kraft pulp, 35 parts of the softwood kraft pulp, and 35 parts of the recycled pulp.

Comparative Example 2

A coated printing paper was obtained in the same manner as described in Example 1 except that the pulp composition in Example 1 was changed to 20 parts of a groundwood pulp prepared from Japanese red pine (*Pinus densiflora*) (GP: hand-made paper sheet density 0.48 g/m$^3$, Canadian Standard Freeness 64 ml), 20 parts of the hardwood kraft pulp, 35 parts of the softwood kraft pulp, and 35 parts of the recycled pulp.

Experimental Results

The evaluation results are shown in Table 1. As shown in Table 1, it could be confirmed that coated papers simultaneously having image reproducibility (reality) and print quality such as resistance to print through can be prepared with stable runnability by including a hardwood-derived mechanical pulp in the raw material.

TABLE 1

| | | | Example 1 | Example 2 | Example 3 | Example 4 | Example 5 |
|---|---|---|---|---|---|---|---|
| Pulp composition | TMP | % | 20 | 40 | 20 | 20 | 20 |
| | GP | % | 0 | 0 | 0 | 0 | 0 |
| | NBKP | % | 35 | 35 | 35 | 35 | 35 |
| | LBKP | % | 20 | 20 | 20 | 20 | 20 |
| | DIP | % | 25 | 5 | 25 | 25 | 25 |
| Mechanical pulp type | | | Eucalyptus | Eucalyptus | Eucalyptus | Eucalyptus | Aspen |
| Passes through 24 mesh | | % | 100 | 100 | 98 | 100 | 100 |
| Retained on 42 mesh | | % | 20 | 20 | 33 | 20 | 26 |
| Hot soft calender | | # of nips | 4 | 4 | 4 | 4 | 4 |
| Surface roughness (PPS) | | μm | 1.5 | 1.8 | 1.7 | 1.6 | 1.8 |
| Specific scattering coefficient | | cm$^2$/g | 50 | 55 | 49 | 52 | 45 |
| Reproducibility after printing | | Visual evaluation | ◎ | ○ | ○ | ◎ | ○ |
| Print through | | Visual evaluation | ○ | ◎ | ○ | ○ | Δ |
| Roughening | | # of fibers/m | 33 | 49 | 40 | 37 | 44 |
| Runnability | | Visual evaluation | ○ | ○ | ○ | ○ | ○ |

| | | | Example 6 | Example 7 | Comparative example 1 | Comparative example 2 |
|---|---|---|---|---|---|---|
| Pulp composition | TMP | % | 20 | 20 | 20 | 0 |
| | GP | % | 0 | 0 | 0 | 20 |
| | NBKP | % | 35 | 35 | 35 | 35 |
| | LBKP | % | 20 | 20 | 20 | 20 |
| | DIP | % | 25 | 25 | 25 | 25 |
| Mechanical pulp type | | | Eucalyptus | Eucalyptus | Softwood | Red pine |
| Passes through 24 mesh | | % | 94 | 100 | 68 | 98 |
| Retained on 42 mesh | | % | 41 | 20 | 14 | 10 |
| Hot soft calender | | # of nips | 4 | 2 | 4 | 4 |
| Surface roughness (PPS) | | μm | 1.9 | 1.9 | 2.2 | 1.6 |
| Specific scattering coefficient | | cm$^2$/g | 47 | 46 | 44 | 49 |
| Reproducibility after printing | | Visual evaluation | Δ | Δ | X | Δ |
| Print through | | Visual evaluation | ○ | Δ | X | ○ |
| Roughening | | # of fibers/m | 55 | 40 | 89 | 60 |
| Runnability | | Visual evaluation | ○ | ○ | ○ | X |

Experiment 2

<Evaluation Methods>

(1) Brightness: determined according to JIS P 8123.

(2) Opacity: determined according to JIS P 8138.

(3) Surface roughness: determined according to ISO 8791/4.

(4) High-speed runnability

Suitability for high-speed operation was evaluated from resistance to web breaks in the press part, resistance to shrinkage-induced wrinkles during calendering, and high durability of elastic rolls. ◎: very good, ○: good, Δ: slightly poor, ×: poor.

(5) Gloss Micro-Unevenness

Gloss micro-unevenness in the final product was visually evaluated. ◎: no blister, ○: negligible, Δ: visible, ×: significant.

(6) Ink Adhesion Unevenness

Printing was performed in a Roland lithographic press (4 color) at a printing speed of 8000 sheets/hr using printing inks (Hy-Unity M from Toyo Ink Mfg. Co., Ltd.) in the order of cyan→magenta→yellow→black, and the resulting print was visually evaluated for print appearance (ink adhesion unevenness) especially in the solid print area and halftone (50%) print area in two colors (cyan, magenta) and cyan alone: ◎: very good, ○: good, Δ: slightly poor, ×: poor.

(7) Surface Strength

Printing was performed in an RI-II printability tester using 0.40 cc of a sheetfed process ink made by Toyo Ink Mfg. Co., Ltd. (SMX tack grade 20), and then the print surface was transferred to a substrate. Surface strength was evaluated from the substrate as follows. ◎: no surface picking observed, ○: some picking observed but convenient, Δ: fairly visible picking and slightly inconvenient, ×: serious picking and unusable.

<Preparation of Coated Printing Papers>

Example 1

The hardwood mechanical pulp used was a hardwood chemithermomechanical pulp (CTMP: hand-made paper sheet density 0.37 g/m$^3$, Canadian Standard Freeness 128 ml) prepared from wood chips of *Eucalyptus globulus* having a volume weight of 580 kg/m$^3$ by the method described herein using sodium sulfite in such manner that 100% by weight of fibers may pass through a 24-mesh screen and 20% by weight of fibers may not pass through a 42-mesh screen when determined according to JIS P 8207.

To a pulp slurry consisting of 20 parts of this CTMP, 20 parts of LBKP, 35 parts of NBKP and 25 parts of DIP were added precipitated calcium carbonate as a filler to an ash content in paper of 11% and 4 parts of a cationized starch as an internal paper strength enhancer to prepare a stock.

This stock was used in a roll and blade gap former type paper machine including two tandem shoe presses at a machine speed of 1600 m/min and dried to give a coating base paper having a basis weight of 43.0 g/m$^2$.

Then, 4.5 parts of an oxidized starch and 8.2 parts of a carboxyl-modified styrene-butadiene copolymer latex were added as adhesives per 100 parts of a pigment containing 73 parts of ground calcium carbonate and 27 parts of kaolin to prepare a coating solution having a solids content of 64% and the coating solution was applied on both sides at a coating mass of 8.3 g/m$^2$ per side of the base paper using a fountain blade coater and dried.

Subsequently, the coated web was calendered using a hot soft calender consisting of 6 stacks of 2 rolls including an elastic roll of Shore D hardness 94° at a metallic roll surface temperature of 100° C. in the first and second nips, a metallic roll surface temperature of 150° C. in the third to sixth nips, and a nip pressure of 250 kN/m in the first to sixth nips to prepare a coated printing paper. In this example, the papermaking, coating and surface-treating steps were continuously performed, so that not only the papermaking speed but also the coating and calendering speeds were 1600 m/min Example 2

A coated paper was prepared exactly in the same manner except that the pulp composition in Example 1 was changed to 20 parts of LBKP, 5 parts of NBKP, 25 parts of DIP, and 50 parts of the hardwood mechanical pulp prepared from wood chips of *Eucalyptus globulus* having a volume weight of 580 kg/m$^3$.

Example 3

A coated paper was prepared exactly in the same manner except that the metallic roll surface temperature in the first and second nips was changed to 60° C. in Example 1.

Example 4

A coated paper was prepared exactly in the same manner except that the metallic roll surface temperature in the third to sixth nips was changed to 220° C. in Example 1

Example 5

A coated paper was prepared exactly in the same manner except that the hardwood mechanical pulp CTMP in Example 1 was replaced by a hardwood mechanical pulp (CTMP: hand-made paper sheet density 0.41 g/m$^3$, Canadian Standard Freeness 130 ml) prepared from aspen chips having a volume weight of 380 kg/m$^3$ in such manner that 100% of fibers may pass through a 24-mesh screen and 26% of fibers may not pass through a 42-mesh screen when determined according to JIS P 8207.

Example 6

A coated printing paper was obtained in the same manner as described in Example 1 except that the hardwood mechanical pulp CTMP in Example 1 was prepared in such manner that 98% of fibers may pass through a 24-mesh screen and 33% of fibers may not pass through a 42-mesh screen when determined according to JIS P 8207 (hand-made paper sheet density 0.33 g/m$^3$, Canadian Standard Freeness 249 ml).

Example 7

A coated printing paper was obtained in the same manner as described in Example 1 except that ground calcium carbonate in Example 1 was replaced by the same precipitated calcium carbonate as used in Example 4 of Experiment 1.

Comparative Example 1

A coated paper was prepared exactly in the same manner except that the pulp composition in Example 1 was changed to 40 parts of LBKP, 35 parts of NBKP, and 25 parts of DIP.

Comparative Example 2

A coated paper was prepared exactly in the same manner except that the hardwood mechanical pulp in Example 1 was replaced by a softwood mechanical pulp (TMP: hand-made paper sheet density 0.48 g/m$^3$, Canadian Standard Freeness 90 ml) prepared from chips of a softwood (radiator pine) having a volume weight of 430 kg/m$^3$.

<Experimental Results>

In the examples, the coated printing papers of the present invention showed good high-speed runnability and high brightness and high opacity as well as good results in gloss micro-unevenness and ink adhesion, in contrast to the comparative examples.

TABLE 2

| | | | Example 1 | Example 2 | Example 3 | Example 4 | Example 5 |
|---|---|---|---|---|---|---|---|
| Pulp composition | LBKP | % | 20 | 20 | 20 | 20 | 20 |
| | NBKP | % | 35 | 5 | 35 | 35 | 35 |
| | DIP | % | 25 | 25 | 25 | 25 | 25 |
| | TMP | % | 20 | 50 | 20 | 20 | 20 |
| TMP type | | — | Eucalyptus | Eucalyptus | Eucalyptus | Eucalyptus | Aspen |
| Passes through 24 mesh | | % | 100 | 100 | 100 | 100 | 100 |
| Retained on 42 mesh | | % | 20 | 20 | 20 | 20 | 26 |
| Roll temperature | 1st & 2nd nips | ° C. | 100 | 100 | 60 | 100 | 100 |
| | 3rd to 6th nips | ° C. | 150 | 150 | 150 | 220 | 150 |
| Roll hardness | Shore D hardness | ° | 94 | 94 | 94 | 94 | 94 |
| Brightness | | % | 83.6 | 82.9 | 83.0 | 82.9 | 81.2 |
| Opacity | | % | 86.2 | 87.1 | 86.0 | 86.3 | 85.4 |
| PPS roughness | | μm | 1.3 | 1.8 | 1.5 | 1.3 | 1.5 |
| High-speed runnability | | Visual evaluation | ◎ | ○ | ○ | ◎ | ○ |
| Gloss micro-unevenness | | Visual evaluation | ◎ | ◎ | ◎ | ○ | ◎ |
| Ink adhesion unevenness | | Visual evaluation | ◎ | ○ | ○ | ◎ | ◎ |
| Surface strength | | Visual evaluation | ◎ | ○ | ◎ | ◎ | ○ |

| | | | Example 6 | Example 7 | Comparative example 1 | Comparative example 2 |
|---|---|---|---|---|---|---|
| Pulp composition | LBKP | % | 20 | 20 | 40 | 20 |
| | NBKP | % | 35 | 35 | 35 | 35 |
| | DIP | % | 25 | 25 | 25 | 25 |
| | TMP | % | 20 | 20 | 0 | 20 |
| TMP type | | — | Eucalyptus | Eucalyptus | — | Radiator pine |
| Passes through 24 mesh | | % | 98 | 100 | — | 68 |
| Retained on 42 mesh | | % | 33 | 20 | — | 14 |
| Roll temperature | 1st & 2nd nips | ° C. | 100 | 100 | 100 | 100 |
| | 3rd to 6th nips | ° C. | 150 | 150 | 150 | 150 |
| Roll hardness | Shore D hardness | ° | 94 | 94 | 94 | 94 |
| Brightness | | % | 83.0 | 85.0 | 84.1 | 78.8 |
| Opacity | | % | 85.9 | 85.9 | 83.4 | 85.2 |
| PPS roughness | | μm | 1.6 | 1.4 | 1.3 | 2.3 |
| High-speed runnability | | Visual evaluation | ◎ | ◎ | ◎ | ◎ |
| Gloss micro-unevenness | | Visual evaluation | ◎ | ○ | ◎ | ◎ |
| Ink adhesion unevenness | | Visual evaluation | ○ | ◎ | ◎ | Δ |
| Surface strength | | Visual evaluation | ○ | ◎ | ◎ | ◎ |

Experiment 3

<Evaluation Methods>

(1) Density: determined according to JIS P 8118.

(2) Brightness: determined according to JIS P 8123.

(3) Opacity: determined according to JIS P 8138.

(4) Surface strength: Printing was performed on one side of a specimen using an offset printing ink (TK Mark V617 from Toyo Ink Mfg. Co., Ltd.) at a constant ink volume of 0.4 cc in an RI-I printer (from Akira Seisakusho) and the specimen was visually evaluated for picking on the surface of the coated paper. ◎: no picking, ○: little, Δ: visible, ×: significant.

(5) Blister resistance: Printing was performed on both sides of a specimen using an offset printing ink (TK Mark V617 from Toyo Ink Mfg. Co., Ltd.) at a constant ink volume of 0.8 cc in an RI-I printer (from Akira Seisakusho) and the specimen was conditioned (23° C., 50% RH) all day and night, and then immersed in an oil bath controlled at a temperature of 140° C. and visually evaluated for blistering. ◎: no blister, ○: little, Δ: visible, ×: significant.

(6) Print through: Printing was performed in 20,000 copies in a rotary offset press (4 color) at a printing speed of 500 rpm using rotary offset printing inks (LEO-XM from Toyo Ink Mfg. Co., Ltd.) in the order of black→cyan→magenta→yellow, and then print through was visually evaluated. Evaluation standards are as follows: ◎: very good, ○: good, Δ: slightly poor, ×: poor.

(7) High-speed runnability: Runnability was evaluated from the frequency of web breaks and boiling during coating. ○: little web breaks and boiling, Δ: some, ×: significant boiling.

<Preparation of Coated Printing Papers>

Example 1

The hardwood mechanical pulp used was a hardwood chemithermomechanical pulp (CTMP: hand-made paper sheet density 0.37 g/m$^3$, Canadian Standard Freeness 128 ml) prepared from wood chips of *Eucalyptus globulus* having a volume weight of 580 kg/m$^3$ by the method described herein using sodium sulfite in such manner that 100% of fibers may pass through a 24-mesh screen and 20% of fibers may not pass through a 42-mesh screen when determined according to JIS P 8207.

A pulp slurry containing 50 parts of this hardwood CTMP, 35 parts of a hardwood kraft pulp (LBKP), and 15 parts of a softwood kraft pulp (NBKP) was prepared, and 12 parts of precipitated calcium carbonate as a filler and a cationic paper strength enhancer as an internal paper strength enhancer in an amount of 0.5% relative to the pulp were added to prepare a stock. This stock was used in an on-top former at a machine speed of 1200 m/min to give a base paper having a basis weight of 37 g/m$^2$.

Then, 20 parts of an oxidized starch and 15 parts of a carboxyl-modified styrene-butadiene copolymer latex as adhesives and 0.05 parts of sodium polyacrylate as a dispersant were added per 100 parts of a pigment containing 90 parts of ground calcium carbonate (FMT-90 from Fimatec) and 10 parts of kaolin (Hydragloss from Imerys) to prepare a coating solution having a solids content of 50% and the pigment coating solution was applied on both sides at a coating mass of 5.0 g/m$^2$ per side of the base paper using a gate roll coater and dried to give a coated paper having a basis weight of 47 g/m$^2$.

Subsequently, the coated web was surface-treated using a soft calender to give a coated printing paper. The papermaking, coating and surface-treating steps were continuously performed, so that not only the papermaking speed but also the coating and calendering speeds were 1200 m/min.

Example 2

A coated printing paper was obtained in the same manner as described in Example 1 except that the pulp composition in Example 1 was changed to 70 parts of the hardwood chemithermomechanical pulp, 15 parts of the hardwood kraft pulp, and 15 parts of the softwood kraft pulp.

Example 3

A coated printing paper was obtained in the same manner as described in Example 1 except that the contents of the adhesives in the coating solution in Example 1 were changed to 25 parts in total (14 parts of the oxidized starch and 11 parts of the carboxyl-modified styrene-butadiene copolymer latex) per 100 parts of the pigment.

Example 4

A coated printing paper was obtained in the same manner as described in Example 1 except that the hardwood chemithermomechanical pulp CTMP in Example 1 was prepared in such manner that 98% of fibers may pass through a 24-mesh screen and 33% of fibers may not pass through a 42-mesh screen when determined according to JIS P 8207 (hand-made paper sheet density 0.33g/m$^3$, Canadian Standard Freeness 249 ml).

Example 5

A coated printing paper was obtained in the same manner as described in Example 1 except that ground calcium carbonate in Example 1 was replaced by the same precipitated calcium carbonate as used in Example 4 of Experiment 1.

Example 6

A coated printing paper was obtained in the same manner as described in Example 1 except that the hardwood mechanical pulp in Example 1 was replaced by a hardwood chemithermomechanical pulp (CTMP: hand-made paper sheet density 0.41 g/m$^3$, Canadian Standard Freeness 267 ml) prepared from aspen having a volume weight of 380 kg/m$^3$ in such manner that 100% of fibers may pass through a 24-mesh screen and 26% of fibers may not pass through a 42-mesh screen when determined according to JIS P 8207.

Comparative Example 1

A coated printing paper was obtained in the same manner as described in Example 1 except that the pulp composition in the base paper in Example 1 was changed to 100 parts of the hardwood chemithermomechanical pulp.

Comparative Example 2

A coated printing paper was obtained in the same manner as described in Example 1 except that the pulp composition in the base paper in Example 1 was changed to 50 parts of a thermomechanical pulp prepared from softwood chips (TMP: hand-made paper sheet density 0.48 g/m$^3$, Canadian Standard Freeness 90 ml), 35 parts of the hardwood kraft pulp, and 15 parts of the softwood kraft pulp.

Comparative Example 3

A coated printing paper was obtained in the same manner as described in Example 1 except that the pulp composition in Example 1 was changed to 50 parts of a groundwood pulp prepared from Japanese red pine (*Pinus densiflora*) (GP: hand-made paper sheet density 0.48g/m$^3$, Canadian Standard Freeness 64 ml), 35 parts of the hardwood kraft pulp, and 15 parts of the softwood kraft pulp.

<Experimental Results>

The evaluation results are shown in Table 3. As shown in Table 3, coated printing papers having low density, high brightness and high opacity as well as print quality such as high surface strength and blister resistance could be prepared with good runnability by including a hardwood-derived mechanical pulp in the raw material and applying a pigment coating layer by the film transfer method.

TABLE 3

| | | | Example 1 | Example 2 | Example 3 | Example 4 | Example 5 |
|---|---|---|---|---|---|---|---|
| Pulp composition | TMP | % | 50 | 70 | 50 | 50 | 50 |
| | GP | % | 0 | 0 | 0 | 0 | 0 |
| | NBKP | % | 15 | 15 | 15 | 15 | 15 |
| | LBKP | % | 35 | 15 | 35 | 35 | 35 |
| | DIP | % | 0 | 0 | 0 | 0 | 0 |

TABLE 3-continued

| | | | | | | |
|---|---|---|---|---|---|---|
| Mechanical pulp type | | Eucalyptus | Eucalyptus | Eucalyptus | Eucalyptus | Eucalyptus |
| Passes through 24 mesh | % | 100 | 100 | 100 | 98 | 100 |
| Retained on 42 mesh | % | 20 | 20 | 20 | 33 | 20 |
| Adhesive in parts | pph | 35 | 35 | 25 | 35 | 35 |
| Density | g/cm3 | 0.69 | 0.61 | 0.72 | 0.66 | 0.69 |
| Brightness | % | 82.8 | 84.7 | 82.6 | 82.9 | 82.8 |
| Opacity | % | 85.6 | 87.4 | 85.4 | 85.8 | 86.1 |
| Surface strength | Visual evaluation | ◎ | ○ | ○ | ○ | ○ |
| Blister resistance | Visual evaluation | ○ | ○ | ○ | ○ | ○ |
| Print through | | ○ | ◎ | ○ | ○ | ○ |
| High-speed runnability | Visual evaluation | ○ | ○ | ○ | ○ | ○ |

| | | | Example 6 | Comparative example 1 | Comparative example 2 | Comparative example 3 |
|---|---|---|---|---|---|---|
| Pulp composition | TMP | % | 50 | 100 | 50 | 0 |
| | GP | % | 0 | 0 | 0 | 50 |
| | NBKP | % | 15 | 0 | 15 | 15 |
| | LBKP | % | 35 | 0 | 35 | 35 |
| | DIP | % | 0 | 0 | 0 | 0 |
| Mechanical pulp type | | | Aspen | Eucalyptus | Softwood | Red pine |
| Passes through 24 mesh | | % | 100 | 100 | 68 | 98 |
| Retained on 42 mesh | | % | 26 | 20 | 14 | 10 |
| Adhesive in parts | | pph | 35 | 35 | 35 | 35 |
| Density | | g/cm3 | 0.71 | 0.54 | 0.74 | 0.67 |
| Brightness | | % | 82.3 | 84.5 | 76.3 | 77.5 |
| Opacity | | % | 85.1 | 87.2 | 82.3 | 83.1 |
| Surface strength | | Visual evaluation | ○ | Δ | ○ | ○ |
| Blister resistance | | Visual evaluation | ○ | ○ | ○ | ○ |
| Print through | | | ○ | ○ | Δ | ○ |
| High-speed runnability | | Visual evaluation | ○ | X | ○ | X |

The invention claimed is:

1. A process for preparing a coated printing paper having a surface roughness of 2.0 μm or less, comprising the steps of:

making a base paper from a raw material containing a hardwood-derived mechanical pulp (LMP) representing 5-80% by weight of pulps in the raw material; and applying a coating solution containing a pigment and an adhesive by an on-machine coater to provide a coating layer;

wherein said steps are continuously performed on machine, said hardwood-derived mechanical pulp (LMP) being a chemithermomechanical pulp (CTMP) in which 95% by weight or more of fibers passes through a 24-mesh screen and 20% by weight or more and 60% by weigh or less of fibers does not pass through a 42-mesh screen when determined according to JIS P8207, and said hardwood-derived mechanical pulp (LMP) derived from Eucalyptus urograndis and/or Eucalyptus globules having a volume weight of 450 kg/m$^3$ or more.

2. The process of claim 1 wherein the machine speed is 1100 m/min or more.

3. The process of claim 1 further comprising the step of surface-treating the coating layer wherein the papermaking, coating and surface-treating steps are continuously performed on machine.

4. The process of claim 1 wherein the coating step is performed by using a blade coater and/or a film transfer coater.

* * * * *